US005986190A

United States Patent [19]

Wolff et al.

[11] Patent Number: 5,986,190

[45] Date of Patent: Nov. 16, 1999

[54] STRING BEARING AND TREMOLO DEVICE METHOD AND APPARATUS FOR STRINGED MUSICAL INSTRUMENT

[76] Inventors: Steven B. Wolff, P.O. Box 1061, Woodacre, Calif. 94973; Gary D. Erickson, 18109 Mt. Washington St., Fountain Valley, Calif. 92708

[21] Appl. No.: 08/953,829

[22] Filed: Oct. 18, 1997

[51] Int. Cl.[6] ..... G10D 3/00

[52] U.S. Cl. ..... 84/297 R; 84/307; 84/313

[58] Field of Search ..... 84/297 R, 298, 84/307, 313, 314 N

[56] References Cited

U.S. PATENT DOCUMENTS

| | | | |
|---|---|---|---|
| 3,178,985 | 4/1965 | Jeranson . | |
| 4,742,750 | 5/1988 | Storey | 84/298 X |
| 4,768,414 | 9/1988 | Wheelwright | 84/307 X |
| 5,208,410 | 5/1993 | Foley | 84/298 X |
| 5,750,910 | 5/1998 | LoJacono | 84/314 N |

*Primary Examiner*—Jeffrey W. Donels
*Attorney, Agent, or Firm*—Larry D. Johnson

[57] ABSTRACT

This is a method and an apparatus that provides string bearings (32) and constant inter string pitch correction and pitch trajectory control tremolo device (64 or 80) for a stringed musical instrument (12). The string bearings (32) allow the strings (18) of the instrument to move freely in the axial direction and to be guided with high stiffness in the radial direction. The string bearings contain low axial friction and high radial stiffness bearing inserts (40) whose surface supports the strings to provide the witness points of nuts, bridges, frets, and finger boards. The material of preference for the string bearing inserts (40) is one of the highest energy resiliency and stiffness and the lowest friction. The string bearings and their inserts are adjustable (32, 56, 42, 58) or fixed position. Adjustments are in the horizontal, vertical, and axial (46, 50, 48) directions or any combination thereof. The constant inter string pitch correction and pitch trajectory control tremolo device (64 or 80 in FIG. 5 or 6) provides the simultaneous correction of string pitch to maintain a constant open tuning ratio relationship throughout all tremolo bar input angles and the control of the strings' pitch trajectories to provide a chromatic (FIG. 8), linear (FIG. 9), natural (FIG. 10), or combination pitch trajectory. Non linear string tension devices from the group of substantially non circular pulleys (66), cams (82), and electrically activated solenoids and motors (96) whose axial displacement table (FIGS. 8A, 9A, 10A) has been designed to provide the constant inter string pitch correction and pitch trajectory control multiplicand of the tremolo bar input (76) angle.

20 Claims, 8 Drawing Sheets

STRING BEARING AND TREMOLO DEVICE METHOD AND APPARATUS FOR STRINGED MUSICAL INSTRUMENT

BACKGROUND

1. Field of the Invention

This invention relates to the nut and bridge nodal points called witness points, as well as frets, and finger boards and the tremolo bridge assembly as used on guitars, basses, pedal/lap steel, piano, and other instruments in the stringed family.

2. Description of the Prior Art

Guitarists want to provide a tremolo action to their playing style. Many tremolos have been devised over the past 50 years. They range in design from tremolos that functionally allow only changes in pitch downward to modern tremolos that allow pitch changes in both directions. A few books that discuss modern electric guitar and bass design, for example, are "Electric Guitar" and "Introduction to Scientific Guitar Design" by Donald Brosnac and "Constructing a Solid Body Guitar" by Roger H. Siminoff.

Many design problems exist in the tremolos over the last 15 years. The most important problem is one of staying in tune. The problem is experienced by the user as strings changing pitch during play due to string metal creep and plasticity. Also standard tuning machines have a tendency to rotate, backlash, and experience beam flex at the stem, providing a further causation of a changing string tension and thus pitch.

To date these issues have been addressed in a number of ways. The first basic method was to provide a nut system witness point that locked the string but allowed the tremolo to move freely. Tuning in this system can only be performed by microtuners or by unlocking the string at the nut, with a wrench. The second type of nut system allows the string to move freely across it. Tuning in this system would be either by standard machine tuners or tremolo microtuners.

Tremolos have had several basic designs, which include a bridge witness point that is a hard knife edge that structurally flexes to allow axial string motion, a roller under each string which provides an upward radial force allowing free axial string motion, and a fixed portion of the tremolo movable assembly so that the combined strings can move axially but have radial fixation.

String dynamics are what provides for various degrees of sustain, harmonics & tone, tuning stability, and tremolo action and reaction. The problems with both of the nut witness point systems is that they do not fully provide an environment that supports the string/neck/body unitary structural combination with the proper support to optimize each of the aforementioned attributes. A major contributor to the diminishment of each of these attributes is the stick/slip action of a standard brass and bone type nut witness point. With this traditional design a V or U shaped grove is supplied to fit the individual diameter of each string, as well as that of it's relative vertical and horizontal position. However, the nature of the brass or bone material is that the string always presses its way into the material by it's axial movement and radial pressure. This is often desired by the usual thinking, and provides not only a solid radial force but, in the negative a large axial frictional force of the stick/slip kind. This force is easily overcome by the change in string tension due to tuning machine adjustment, but NOT by the micro-movements in the axial displacement component of the string motion during vibration. The nature of this type of frictional motion is highly non-linear and stochastic in nature. In addition, the nature of this type of force in combination with tuning peg problematic movement, versus intentional tuning adjustments, and knife edged and/or hook return spring based tremolo bridges, constitutes a serious departure from the structural support requirements of the ideal string dynamics as discussed herein.

Typical tremolo designs all have a large disadvantage in that the pitches of the individual strings alter significantly from the inter string pitch ratios of open string tuning. Very quickly the strings each take a different pitch trajectory from the ideal. A secondary result is the lower pitch strings reach slackness well before the higher pitch strings. In addition the pitch trajectories follow an uncontrolled path where each string has its unique and un-orchestrated pitch trajectory. Therefore even the best musician cannot control their music in a fully chromatic or even linear way. This problem precludes a fundamentally basic need in musicology of retaining chromatic order. The ability to produce inter string (note) and chromatically correct music during pitch changes is something almost any synthesizer keyboard can provide.

Secondly tremolo design has been nearly exclusively based upon variations in the knife edge pivot point and roller or edge or rotational witness point type tremolo bridge assemblies. As discussed in the previous section these bridge witness point designs have disadvantages in their approach to string support and produce an adverse effect on string dynamics.

Thirdly in addition to these disadvantages, there exists those intrinsic to knife edge and post pivot designs and hook spring return support blocks. The typical knife edge and post pivot design provides the tremolo with a cost effective way to locate the tremolo axially as well as horizontally and vertically. Usually one post has a semi-circular groove on the tremolo body while the other has a straight edge, the later to allow for location without misalignment. The tremolo body is forced into the post groove by the opposing tensions of the six strings and the two or three hook tension springs. Therefore the static and dynamic axial and radial forces of the six strings are opposed by the two slender posts and the tremolo body hook springs. The knife edge and post groove interface as well as the hook tension springs provide a series of extra resonances, energy storage mechanisms, and highly non-linear forces. Moreover as the tremolo is used and the relative angle of the tremolo body is changed so also the attack face of the knife edge and post groove interface changes, adding further to the stick/slip friction. All these actions take away from the optimum string support and thus diminish the string dynamics comprised of the sustain, harmonics and tone, tuning stability, and tremolo action and reaction.

It could be argued that these non-linear effects add to the "sound"; they may add a type of character to the sound but only detract from user control and the rest of the string dynamics.

Applicant's therefore feel the value of a complete solution to these problems lies in the user's experience of longer sustain, greater tone, more stable tone and phase decay, better feel, stable tuning, improved intonation accuracy, smoother tremolo action/reaction, and force feedback.

Appliant's shall first examine the notable prior art of guitar nut witness points in as regards to the invention, described herein, of String Bearings. The range of interesting prior art includes patents from as early as Faas U.S. Pat. No. 118,353; Hafer U.S. Pat. No. 550,268; and Eurich U.S. Pat. No. 3,695,137; to the contemporary U.S. Pat. No.

4,171,661 Rose; U.S. Pat. No. 4,475,432 Stroh; to most recently U.S. Pat. No. 4,517,874 Fender. In applicant's opinion the landmark patent of this series is that of Rose U.S. Pat. No. 4,171,661. Rose developed a good knife edge/post pivot based tremolo bridge and provided locking mechanism on both ends of the scale length of the strings; the nut and bridge witness points. This was acclaimed by Rose and the industry at the time as the way to insure maintenance of the tuning of the strings while under the strain of the tremolo operation. Many licences of the Rose system continue today producing variations of the lock nut or knife edge bridge. The main theoretical advantage of locking the strings at the Nut Witness point is the maintenance of proper tuning. However this is largely abated by the the need for bridge mounted tuners, lock nut wrenches, and the warped or deformed strings that result from their use. These disadvantages are mechanical, however the dynamic disadvantages also include less tone, instable tone and phase decay, and less smooth tremolo action/reaction, and force feedback for the user. Nevertheless at the time of the Rose patent only the mechanical disadvantages where evident and prompted Edwards U.S. Pat. No. 4,579,033 to develop and patent the Finger Operated Lock Nut. This design obviated the need for wrenches to loosen and re-tighten the clamping action on the strings. The mechanical disadvantages remain albeit less so. With this design the user must still lift the nut's locking handles and then tune/re-tune and re-tighten the handles before continuing. However this design has done nothing to improve string dynamics. It's disadvantages include less tone, instable tone and phase decay, and less smooth tremolo action/reaction, and lower force feedback. Also it is apparent from the use of the locking nut that once the instrument has been tuned that the very clamping action of the lock nut may rechange the tuning parameter once again away from the tuning where the user had previously adjusted it.

Applicant's strong opinion, and the basis for part of the Sting Bearing invention, is that in order to optimize the string dynamics as previously discussed one must allow the string to move axially over the Witness Point with only radial force present. A highly linear and high stiffness structure must provide near zero axial force due to resistance or friction. This must occur for the micro-displacement movements caused by the combinatorial motion of the string and guitar neck/body movements. These motions are on the order of acoustic and flexural displacement axial motions present in a vibrating structure such as a guitar or other stringed instrument.

Applicant's should further point out that standard bone or brass type nuts with fixed cut string groove, require adequate down pressure of the strings into the nut grooves. These grooves are intentionally cut to provide very high grabbing friction from the sides of the nut's grooves to the strings. This friction can be overcome by tuning adjustments. These structures therefore impose a large axial friction force on the strings due to the micro-displacement movements of the strings during play, thus producing an additional undesirable and adverse affect on the string dynamics. Additionally such typical nuts provide low radial stiffness whose characteristics are not linear. Moreover, when a tremolo type bridge is used the normal axial forces imposed by the tremolo action on the strings cause a stick-slip friction response by the V groove and nut interface. This type of force dynamic has an additional adverse effect on the string dynamics.

With these issues in mind it is applicant's opinion that the second landmark patent, in regards to prior art nut witness point technologies, lies in Wilkinson U.S. Pat. No. 4,709,612. Wilkinson also cites U.S. Pat. No. 2,191,776 Schrieber and U.S. Pat. No. 2,905,402 Hoyer. The Nut for Stringed Instruments amounts to a block with individual rollers supporting each string and guidance shapes such as a V shape to guide the entrance and exit of each string in their path to the tuners (this function is normally performed by a string tree guide). It should also be noted that Witness Point technology for the Bridge end can be found in various roller forms such as Storey U.S. Pat. Nos. 4,457,201 and 4,487,100. These rollers however are in a pulley form with a true bearing while Wilkinson's are of the wide cylindrical type riding on their circumferential area. The problems with the Roller Nut are manifold. Practice has shown that the strings do not actually cause the rollers to rotate because of the opposing friction force generated between the rough body's interior and the small diameter roller. In fact the string slides and deforms while crossing the small diameter rollers. The resulting string deformation is plastic, not elastic, and causes many problems in the string dynamics, as previously discussed. Even true pulley rollers, as in Storey's design, have this mechanical behavior in response to the aforementioned micro-displacement movements present in real vibrating systems. It should be pointed out that the Roller Nut does provide the benefit of Tuning adjustments that can be performed without the aforementioned drawback of wrench operated or lever operated Lock Nut designs. These adjustments however comprise relatively gross axial motions in comparison to the aforementioned micro-displacement movements present during string vibration. A final disadvantage of the Wilkinson Roller Nut is that the friction due to the aforementioned micro-displacement movements is exacerbated by the string's rubbing on the sides of the V shape entrance and exit areas.

Applicant's have not discovered any prior art that covers the issues of vertically, horizontally, axial, or any other combination thereof, adjustable nut witness points.

These nut systems, as well as standard bone or brass fixed cut groove style nuts often require a string tree guide for several of the strings. String trees help to maintain an adequate down pressure of those strings into the nut grooves. These structures also impose a friction force, or even plastic deformation force due to the micro-displacement movements of the strings, thus producing additional undesirable results.

The value of solving the problem of the nut witness point lies in improving the string dynamics which in turn allows the user to experience longer sustain, greater tone, more stable tone and phase decay, better feel, stable tuning, improved intonation accuracy, smoother tremolo action/reaction, and force feedback. Operational and mechanical improvements should include: no nut wrench or handle adjustments required, strings do not become plastically deformed (kinked), tuning adjustments are single step only, intonation adjustments are easier, no string tree guides should be required, and strings should not cut themselves deeper into the nut grooves with time. These improvements reduce maintenance cost as well.

The requirements for a novel solution to these problems should provide a basis that allow the dynamics of the strings and instrument structure combination to truly move freely in the axial direction while simultaneously transmitting the vibratory forces of the strings into the instrument without loss or distortion in the radial direction.

Applicant's shall demonstrate that the string bearing invention described herein meets or exceeds these requirements.

Applicant's shall secondly examine the notable prior art in as regards as to Tremolo Bridges. From the early patents such as Faas U.S. Pat. No. 118,353; Van Dusen U.S. Pat. No. 462, 519; Weber U.S. Pat. No. 509,414 and Farigenele U.S. Pat. No. 2,214,957 to the early Fender patent U.S. Pat. No. 2,741,146; and followed by Burns U.S. Pat. No. 3,196,729. Many patents on fixed and tremolo bridges exist.

However the landmark patent in applicant's opinion is that of Rose U.S. Pat. No. 4,171,661. Rose developed a good knife edge/post pivot based tremolo bridge and provided locking mechanism on both ends of the scale length of the strings; the nut and bridge end. Licensing of the Rose system as enforced by his patent continues today. The main issue that appears to be both unique as well as enforceable is the knife edge and post pivot claim.

Some of the most notable tremolo patents are: Storey U.S. Pat. No. 4,457,201 & U.S. Pat. No. 4,487,100 and Wilkinson U.S. Pat. No. 4,709,612. Some tremolo and fixed bridge patents are:

| U.S. patents | | | | |
|---|---|---|---|---|
| 118353 | 3563126 | 4464970 | 4843941 | D269440 |
| 462519 | 3695137 | 4475432 | 4856404 | D290017 |
| 509414 | 4171661 | 4487100 | 4867031 | D302563 |
| 550268 | 4206679 | 4538498 | 4913024 | RE32863 |
| 2191776 | 4230014 | 4574678 | 4928564 | |
| 2214957 | 4334454 | 4579033 | D244051 | |
| 2741146 | 4430919 | 4677891 | D260271 | |
| 2905402 | 4464970 | 4709612 | D268272 | |
| 3196729 | 4517874 | 4724737 | D269438 | |
| 3453920 | 4457201 | 4811646 | D269439 | |
| Foreign Patents | | | | |
| 620858 | | | | |
| 3996 | | | | |
| 72716 | | | | |

The Rose patent is a landmark primarily because of the knife edge and post pivot design. The Storey patents are interesting because of the micro-tuner and height adjustments as well as mono-cam style rotation of the bridge end string terminations. Important is the "autolatch" device which allows the user to lock the tremolo into neutral center position by use of the tremolo bar rotation. The Wilkinson patent shows an elegant string termination method. Practically however the pivot design is a variation on the Rose patent.

These patents have no bearing on the invention herein described.

Additional prior art of significance is from the Steinburger company. They have developed and are now selling a tremolo with a form of pitch correction. No patents appear at the time of this writing to be issued. The units sold have been marked with the phrase "Patent Pending" and are called the 'TransTrem'. The tremolo has been designed to provide for locking the device at specifically calibrated positions in order to allow the user to put the tuning up or down specific steps in pitch. This function is called transposition and has been performed using a typical Capo which is applied on the finger board near the top (nut end) frets. After examination of the production tremolo device applicant's have observed that it has a rotatable assembly with six saddles, one per string. The strings terminate in the saddle whose relative circumferential adjustment allows that each string will have a unique fixed effective radii from the assemblies effective center of rotation. Applicant's have, in applicants work with the invention described herein, proved that such a structure can only provide an effective inter string pitch correction if the set of effective radii that are produced during the assembly's rotation are exact. Applicant's have determined that the Steinburger design could only provide inter string pitch correction within a narrow range or rotation. It is therefore inadequate and inexact for this first task. Furthermore the Steinburger has no facility to provide chromatically correct, or any other, pitch trajectory control. Its ability to provide a transpositional function is derived from calibrated steps provided for the user to leave the tremolo in a particular position to achieve say a step or half-step down. This function is NOT an intrinsic aspect of their design but is no doubt the result of a trial and error effort which resulted in the development of tremolo angle position indentations that provide only specific settings. The use of theoretically constant radii CANNOT provide any continuously chromatic functioning. Furthermore the design that applicant's have inspected is not capable of accurate inter string pitch correction and may not provide true pitch coherence as well.

Most of these tremolo designs have several major drawbacks in their design from a string dynamic, as well as a guitar neck & body dynamics, point of view. Primarily they are the vibratory and acoustic dynamic characteristics of the knife edge and post pivot and those of the hook return springs. Secondly their use of rotating, flexing, or V groove Bridge Witness points is also a large drawback.

The drawbacks of the knife edge and post pivot design lay in three areas. The first is in the rotational micro-angular changes in the interface between the groove on the tremolo support base plate and the post knife edge type head. This changing interface is highly non-linear and contributes mechanical noise to the subtle displacements due to the string/instrument dynamics. Secondly, the interface itself between the knife edge post head and the base plate screw along with the contribution of the changing interface attack surface, is one whose mechanical acoustic wave signal impedance characteristics are dubious. The impinging stress wave due to the normal string dynamic cannot easily pass through this pivot structure without large distortion and reflection. Thirdly, the post itself is a resonant structure of fairly high resonant frequency which should on first examination be in the upper frequency range of musically useful interest. On further examination one can see a highly unusual acoustic/mechanical impedance mismatch between the various guitar components such as the neck, body, even the tuning pegs and the two small pivot posts on the typical tremolo. The various guitar components such as the neck, body, and the tuning pegs (1 per string) have a much higher stiffness and certainly more stable acoustic/mechanical impedances than do the two small posts that must carry the entire reactive force component into the body of the guitar in both radial as well as axial directions.

The drawbacks of using hook springs to provide return action in opposition to the strain of the strings in these tremolo designs lies in a similar way to the drawbacks inherent in the knife edge post, namely they are insuffcient nonlinear mechanical elements with regards to stress wave mechanical signal impedance. Unlike posts, hook type return springs have fundamental resonant frequencies within the frequency bands of interest. They contribute both resonant and anti-resonant peaks to the response spectra of the structure. This effect is most often to the detriment of the dynamics, and playability, of the instrument.

The drawbacks of rotating, flexing, V groove, and pulley Bridge Witness points lies in several areas. For rotating cam like witness points as found on many tremolo bridges such as Storey and Wilkinson, they lack a true witness point.

Namely the string flexes around the surface of the cam and does not actually have a radial witness point per se. Only friction and the final anchor point provide a radial reactive force component. In addition most designs actually move the witness point axially while rotating. For flexing type witness points the drawbacks include that the witness point moves axially as well as the string must drag the witness point structure along with itself by only the friction between them. For typical rigid V groove witness point bridges the strings have a large friction force axially as well as a stick-slip friction response action. Lastly for pulley type witness points, they provide low axial friction but add an undesirable dynamic due to the mechanical clearance of the elements. Moreover usually this pulley type witness point has been made to move its effective axial position with the tremolo rotation causing the overall string length to change with operation. All these aforementioned actions provide undesirable results by combining both string tension and length based pitch changes simultaneously, and add a frictional element that is highly non-linear and damping on the vibratory string dynamics. All these actions are clearly undesirable from the point of view of string dynamics, intonation, tonality, and playability.

The final major drawback of all these prior art tremolo designs is they lack the ability to maintain a relative and accurate tune between the six strings. This is true because when all the strings have a relatively fixed relation among them the high strings will provide a different pitch change factor than the lower strings for an equal change in string length. This is because the typical tremolo designs such as Storey and Rose change the displacement of all the six strings equally.

Such equal displacement change CANNOT provide for constant inter string tuning nor for any type of pitch trajectory control.

Mechanically, the ideal for a witness point and tremolo bridge is:

First to maintain a constant string length by not moving the positions of the nut or bridge witness points.

Secondly, provide for the strings to be elastically strained to provide the pitch change.

Third, the strings must remain in relative open tuning pitch ratios to one another while the overall tremolo pitch change occurs during tremolo operation.

Fourth, the trajectories of the pitches of the strings must be controlled to provide continuous and accurate, chromatically correct music.

Fifth, the ideal in an acoustic wave sense for a witness point and tremolo bridge is to allow the acoustic mechanical stress waves to pass through the tremolo structure without gross mechanical impedance changes and without resonant structures with resonant frequencies either in the band of interest or with transient responses much less than those of the neck and strings and the other major mechanical guitar components.

No prior art patented or not patented, known to these writers provides these five criteria in total or in majority.

SUMMARY OF THE INVENTION—OBJECTS AND ADVANTAGES

The present invention is based on the fact that in order to optimize the string dynamics one must allow the string to move over the Witness Point devices with only radial force present due to a highly linear and high stiffness structure and have zero axial force due to resistance or friction. This must occur during the micro-displacement movements caused by the combinatorial motion of the string and guitar neck/body movements. These motions are on the order of acoustic and flexural displacement axial motions present in a vibrating structure such as a Guitar or other stringed instrument.

The string bearings of the invention described herein are utilized for the purposes of nut, bridge, fret, and fingerboard stringed instrument witness points and bearing surfaces.

The basis for applicant's claims in regards to the String Bearing invention is this opinion.

The present invention is also based on the fact that the inter string pitch ratios, slack position, and most important the pitch trajectories of typical tremolos are not chromatically correct for both inter string pitch tuning and pitch trajectory. The invention described herein provides for this functionality by a series of non-linear string tensioning devices, one per string tuned to that string, whose characteristics provide for inter string pitch correction with chromatic, or linear, or natural pitch trajectory control.

In addition, the dynamic characteristics of the tremolo invention in regards to transmission and re-transmission of acoustic stress wave signals, and in regards to reflection and anti-reflection, and mechanical impedance matching of the various elements, should be optimized to minimize these signal mismatches and to match mechanical stiffness and damping of the various elements to one another and to the body and neck of the instrument.

The basis for applicant's claims in regards to the Constant Inter String Pitch Correction and Pitch Trajectory Control Tremolo invention are these opinions as previously stated.

The present invention incorporates for the interior string contact surfaces of the string bearings, the use of extremely high hardness, stiffness, smooth finish, and high energy resilient materials.

Secondly the shape of the string bearing may be optimized as a hollow tube containing various internal radii and is intimately and solidly set into a holding material so as to afford an internal contact surface but also to afford string entrance and exit ability. Entrance and exit radii provide for the directing of the string angle towards the tuning machines such functionality is found ordinarily in string tree guide devices.

Thirdly said string bearing assembly may be adjustable both in its vertical position relative to the surface of the fingerboard, adjustable in its horizontal spacing so as to afford a universal witness point spacing to neck width conformability, and be adjustable in its axial witness point placement as well. The later is mandatory for the string bearings of the bridge witness point, optional for the nut witness point and may not be necessary for the fret or the surface of the finger board.

The present invention also incorporates for the tremolo invention an assembly mechanism that allows the axial motion of each string termination without any motion in the bridge witness point. Moreover said mechanism allows that the string terminations exhibit very high relative radial stiffness and well matched mechanical impedance in regards to mechanical stress wave signal propagation to and from the string and body. Equally important is that the mechanism must perform well in the same regards as the radial performance in the axial direction while simultaneously having the ability to move freely in response to tremolo bar input angle operation. Additionally the acoustic mechanical wave signal performance and mechanical operations should be performed without the use of knife edge and post pivot design and of hook return springs. Also the use of rotating, flexing, V groove bridge witness points should be avoided. The tremolo action in regards to automatic relocation of the pitch when the user ceases to perform tremolo action should be operated in a manner to isolate any return springs from the acoustic mechanical stress wave signal path. Such is not the case with hook return springs in prior art tremolo design.

Secondly, the tremolo mechanism assembly should make appropriate and smooth continuous correction to each individual string's tension so as to adjust each individual pitch to maintain the pitch of all the stings in constant inter string relative tuning and intonation. In other words pitches of the string set, which when in tune are High E, B, G, D, A, and Low E (2 octaves down), would remain always in this relative pitch ratio relationship regardless of the tremolo action. Currently tremolos adjust all the strings with equal axial displacement. Generally the other strings will collapse in pitch at a much faster rate than the High E. The Low E will become totally slack well before the High E. To provide constant inter string pitch correction performance the present invention must provide for a unique axial length adjustment as well as a common adjustment, such as is normal to tremolo designs. This action would have all the strings track one another including to the point of all becoming slack at the same position. However the trajectory of the 6 string's pitches could have several paths which give very different response to the user. Applicant's have devised three paths but are not limited to just three. They are the Chromnatic, Linear, and Natural pitch trajectories.

The Chromatic pitch trajectory method has incorporated a 2 to the $\phi$ ($2^{\phi}$) power function relationship so as to provide an axial displacement relationship that will not only provide the constant inter string tune but also cause all the strings'pitches to track the tremolo bar's input angle ($\phi$) in a chromatic function which will cause all the strings to go towards slack equally. In other words the pitches of the strings will increase or decrease in continuous chromatic intervals, such that the pitches will track the tremolo bar's input angle. That is if the bar is depressed down say half way and a 6 step pitch decrease is accomplished and then the bar is depressed an additional equal amount of angle an additional 6 step pitch (now a full octave down) decrease will occur. This function is most useful for musicians who want a chromatically accurate relationship between the tremolo bar and the pitch of each string. This function is provided by the pitch bend wheel in all good digital synthesizers and keyboard musical instruments.

Secondly the Linear pitch trajectory method incorporates a square of $\phi$ relationship so as to provide an axial displacement relationship that will not only provide the constant inter string tune but also cause all the strings'pitches to track the tremolo bar's input angle as a linear function as well as all the strings will go slack at the same tremolo bar position. In other words the pitches of the strings will increase or decrease the same percentage change over an initial 5 degree input as the next 5 degree input.

Thirdly the Natural pitch trajectory method maintains the constant inter string tune relationship but the pitches of the individual strings change according to the natural square root function of the string in response to axial displacement change, as well become slack at the same tremolo bar position.

The present invention consists of string bearings that are adjustable or fixed and contain bearing surface materials with properties of extremely high hardness, modulus of elasticity, energy resilience, non-abrasiveness, and smoothness.

The materials of preference for this surface are crystalline grown Ruby and Sapphire, sintered Silicon Carbide, ceramic Alumina, Quartz, and piezo materials, Glass/Pyrex/Porcelain, some plastics/ceramic alloys, and hard chromed steel and other metals, but are not limited by this list. By far the material of preference to meet the stated optimal requirements is the crystalline grown Ruby and Sapphire which has the highest known resiliency, a very high modulus of elasticity and is non-porous and thus non-abrasive.

The string bearing witness points can be adjustable or fixed depending upon the application. Adjustable witness points can have Vertical, Horizontal, and Axial positioning mechanisms. They can also have adjustments in only one axis such as in the Vertical direction or a combination of axes. Fixed string bearing witness points such as a nut or fret are common in typical use. Fixed string bearings are thus also included in the present invention.

The present invention also consists of a tremolo bridge system that pulls the strings each in an individual way so that several objectives are met. First that the strings stay in relative constant inter string tune, that is the High E remains 2 octaves above the Low E at all tremolo bar positions within the normal limits of string strength or playability, and all the strings perform in this manner. Secondly that all the strings go slack, that is to zero or the lower pitch limit, at the same tremolo bar position. Thirdly that all the strings'pitches track the tremolo bar in one of many useful pitch trajectory ways which include:

One they can track in a Chromatic way. For example if half the tremolo bars angular range was equivalent to 6 half steps then depressing the bar fully would achieve a whole octave. The chromatic function is 2 to the Nth power such that $2^{6/12}$ indicates a half octave up from open tuning pitch, for example.

Two they can track in a Linear way that is they change pitch in linear proportion to the tremolo bar angle.

Third they can track in a Natural way of following the square root function of the strings natural pitch function.

These actions can be performed by the use of complex surfaces or radii functions such as cams, rollers, pulleys, or lever mechanical sections, as well as electromechanical devices, whose actions are based upon the computed functions derived from the string physics equations and the target objectives as stated henceforth operating upon the user's actions upon the tremolo bar input angle.

The basic equation for the pitch of a string is as follows:

$$f_{freq_of_string} = \sqrt{(A_{crossection} \times E_{modulus} \times Disp_{of_string} / L_{total})}\, 2 \times L_{witness} \times \sqrt{(A_{crossection} \times Dens / G_{grav_cons})}$$

or more simply $$f_{freq_of_string} = K_{string} \times \sqrt{Disp_{of_string}}$$

Where: $$K^{0}_{string} = \sqrt{(A_{crossection} \times E_{modulus} / L_{total})}\, 2 \times L_{witness} \times \sqrt{(A_{crossection} \times Dens / G_{grav_cons})}$$

and $K0_{string}$ is the dynamic characteristics for this string.

$K1_{Hz/deg_string}$ is the chromatic pitch trajectory constant for this string.

$K2_{deg/oct_string}$ is the liner pitch trajectory constant for this string.

$K3_{disp/deg_string}$ is the natural pitch trajectory constant for this string.

$\phi_{degrees}$ is the tremolo bar input angle.

The invention's tremolo function as aforementioned is provided by a non-linear string tensioning device comprised of a rigid shaft with a series of rigid pulley like elements, cam like elements, or electromechanical elements, whose tensioning displacement shall conform to the table of tremolo bar input angle versus tensioning displacement multiplicand one per string which may be derived from the following equations:

First for the constant inter string pitch correction and Chromatic pitch trajectory control shall conform to the following two equations:

1 chromatic pitch trajectory tensioning displacement is:

$$Disp_{of_string} = ((f_{freq_of_string_Open_Tune} \times 2 \wedge (\phi / K^2_{deg/oct_string})) / K^0_{string}) \wedge 2$$

2 constant inter string correction is:

$$Disp_{of_string} / Disp_{of_High_E_string} = (K^0_{string} / K^0_{of_High_E_string}) \times (f_{freq_of_string_Open_Tune} / f_{freq_of_High_E_string}) \wedge 2$$

Second for the constant inter string pitch correction and Linear pitch trajectory control shall conform to the following two equations:

1 linear pitch trajectory tensioning displacement is:

$$Disp_{of_string} = (((\phi + 20°) \times K1_{Hz/deg_string}) / K0_{string})^2$$

constant inter string correction is:

$$Disp_{of_string} / Disp_{of_High_E_string} = (K^0_{string} / K^0_{of_High_E_string}) \times (f_{freq_of_string_Open_Tune} / f_{freq_of_High_E_string}) \wedge 2$$

Third for the constant inter string pitch correction and Natural pitch control shall conform to the following two equations:

1 natural pitch trajectory tensioning displacement is:

$$Disp_{of_string} - (\phi + 20°) \times K3_{disp/deg_string}$$

2 constant inter string correction is:

$$Disp_{of_string} / Disp_{of_High_E_string} = (K^0_{string} / K^0_{of_High_E_string}) \times (f_{freq_of_string_Open_Tune} / f_{freq_of_High_E_string}) \wedge 2$$

Moreover the invention will not utilize post and knife edge hinges and hook style return springs. Also the bridge witness point must be fixed to the instrument's body and segregated from the actual moving tremolo section to achieve the aforementioned functions.

In addition the use of string termini or string like sections for return springs may be utilized.

The present invention produces the result of greatly improved string sustain, tone, intonation, phase decay, playability, string life, and resonance. Secondly the result of improved tremolo action of all the strings remaining in constant relative tune, and linear or chromatic string relation to the users tremolo bar input is very musically useful.

The present invention is limited to all stringed instruments that have witness points or fingerboards such as guitar, pedal steel, bass guitar, piano, violin etc both acoustic and electric, but primarily electric guitar, pedal/lap steel, and basses that have tremolo style bridges.

The present invention achieves the capability to give all stringed instruments improved string dynamics and secondly to give tremolo systems improved acoustic wave dynamics and to provide a constant tune and linear or chromatic tremolo bar input to pitch function.

The present invention is valuable because it optimizes the acoustics, intonation, and playability for the stringed instrument and secondly the tremolo allows for acoustic and playability improvements valued highly by professional musicians.

BRIEF DESCRIPTION OF THE DRAWINGS

FIG. 3 also shows a low axial friction, high radial stiffness and hardness fret and finger board string bearing affixed to a typical guitar neck.

FIG. 6B shows an electromechanical element from the group of solenoids and motors providing non-linear string tensioning, in place of a cam.

REFERENCE NUMERALS IN DRAWINGS

| | |
|---|---|
| 12 | typical guitar neck, nut, and string tree |
| 14 | typical nut |
| 16 | v-notch in nut witness point element |
| 18 | string(s) |
| 20 | string tree guide for highest pitch three strings |
| 22 | fret |
| 24 | typical bridge |
| 26 | bridge witness point element |
| 28 | v-notch in bridge witness point element |
| 30 | horizontal adjustment screw |
| 32 | assembly of horizontally, vertically, and axially adjustable string bearing nut witness point |
| 34 | base plate |
| 36 | saddle with adjustment |
| 38 | vertical adjustment screw |
| 40 | string bearing inserts front and back on each saddle |
| 42 | high hardness string bearing fret |
| 44 | adjustable string bearing bridge witness point saddle |
| 46 | horizontal adjustment screw |
| 48 | axial adjustment screw |
| 50 | vertical adjustment screw |
| 52 | bridge string bearing inserts front and back per saddle |
| 54 | bridge base plate |
| 56 | assembly of horizontally, vertically, and axially adjustable string bearing bridge witness point |
| 58 | high hardness finger board string bearing |
| 60 | pin for affixing 6 string bearing witness point saddles |
| 62 | as in 56 or suitable variation |
| 64 | constant inter string pitch correction and pitch trajectory control tremolo first variant |
| 66 | non-linear string tension devices from the group of substantially non circular pulleys |
| 68 | strings |
| 70 | string termination points |
| 72 | shaft |
| 74 | shaft input to tremolo assembly |
| 76 | helical or torsional return springs and tremolo bar input |
| 78 | as in 56 or suitable variation |
| 80 | constant inter string pitch correction and pitch trajectory control tremolo second variant |
| 82 | non-linear string tension devices from the group of substantially non circular cams |
| 84 | assembly of six element cam follower and pistons with strings |
| 86 | cam follower pivot bearing pin |
| 88 | piston, piston cap and string termination |

-continued

| | |
|---|---|
| 90 | cam follower and piston actuating lever |
| 92 | cam surface in contact with cam follower |
| 94 | string termination showing through piston cap |
| 96 | non-linear string tension devices from the group of electrically activated solenoids and motors |

DESCRIPTION OF A PREFERRED EMBODIMENT

Description of the FIGS. 1 through 10

Figure 1:
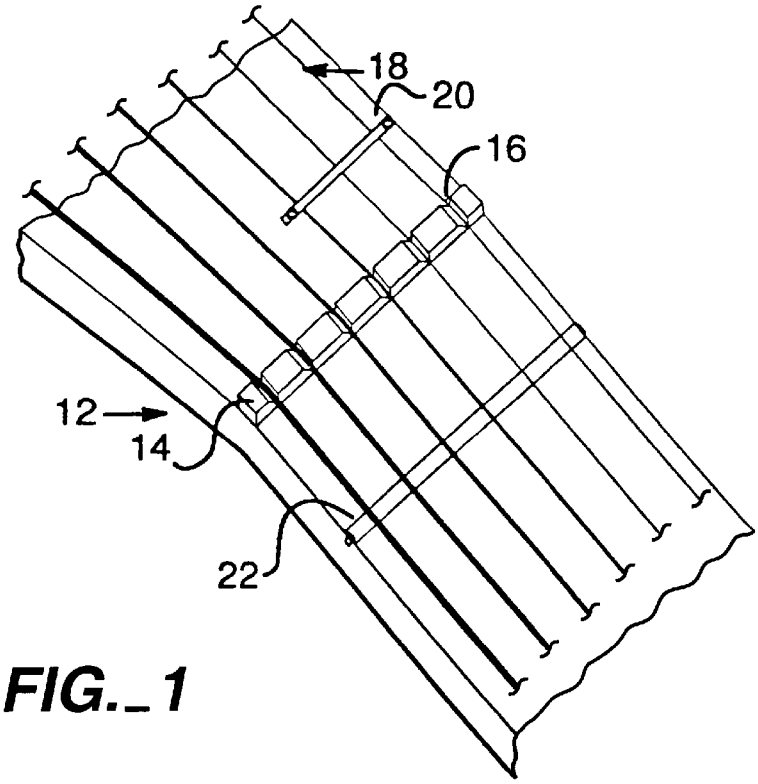
FIG. 1 shows a typical guitar neck in the area of the nut witness point and the six strings with the usual three high strings going under a string tree and a fret is shown on the finger board.

A typical guitar style nut witness point is shown FIG. 1. It should be examined in reference to the basic parts of a guitar upper neck which consist of neck 12, metal or bone nut 14, v-notch in material of nut 16 for strings, high E to lower E, 18 and string tree 20 for guiding the strings toward the tuning pegs or other terminations. The metal to metal contact of the v-notch serves as the bearing surface of the typical nut 14.

Figure 2:
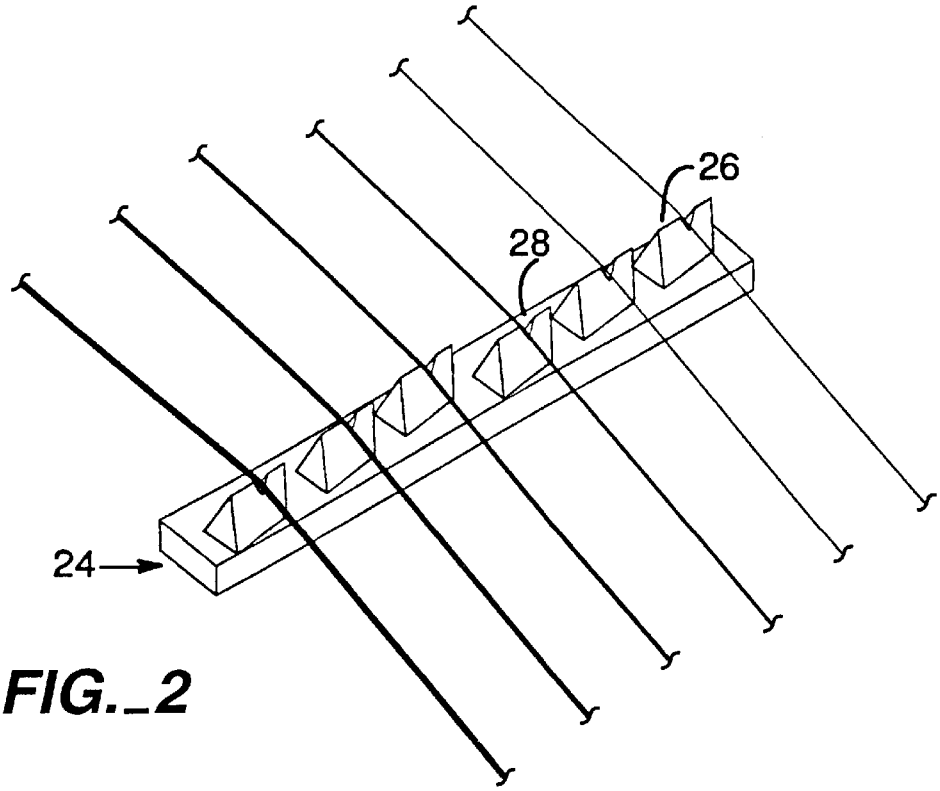
FIG. 2 shows a typical bridge with fixed or adjustable V-notched witness point elements and the six strings.

In addition a typical bridge witness point is shown in FIG. 2. This figure illustrates the basic elements of a bridge witness point for a guitar or other stringed instruments. The base 24 allows the fixed or adjustable witness saddle assemblies 26 to hold the strings 18. The v-notches 28 allow the strings to seat and form the witness points.

A typical guitar style tremolo is not shown but consists of knife edge and post pivots and hook springs in opposition to the strings' tension. All strings change axial displacement an equal distance during tremolo bar input angle changes.

Figure 3:
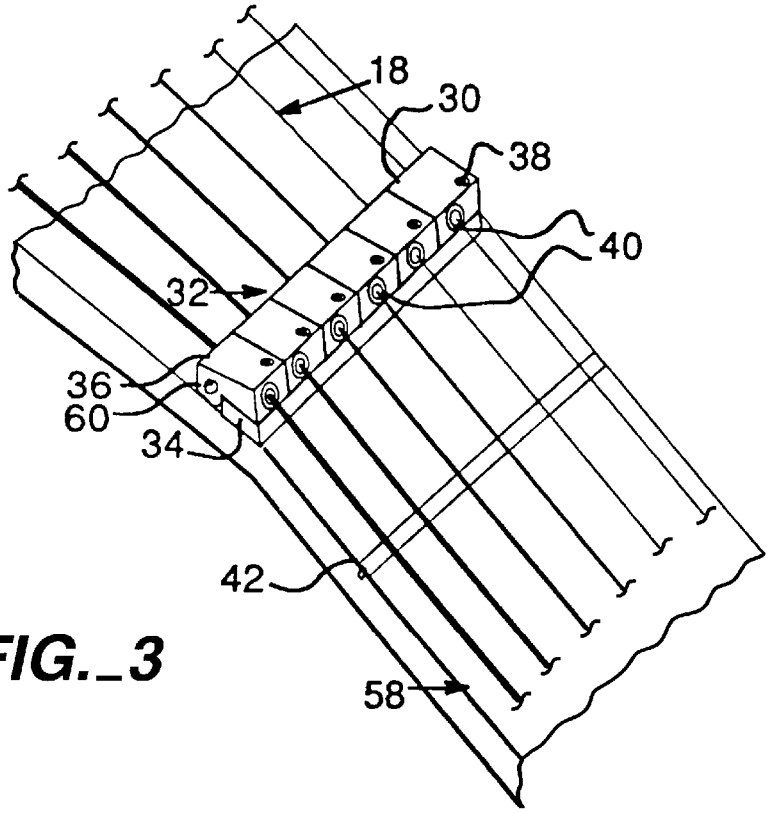
FIG. 3 shows a horizontally and vertically adjustable string bearing nut containing low axial friction, high radial stiffness string bearing elements affixed to a typical guitar neck.

The preferred embodiment of the String Bearing invention is shown in FIG. 3. Here a horizontally and vertically adjustable string bearing witness point nut containing low axial friction high radial stiffness string bearing elements is shown in sufficient detail as in FIG. 3 for those skilled in the art to construct it. The device 32 is comprised of six saddles with adjustment screws 36 attached to a base plate 34 by a pin 60. Each saddle contains a vertical adjustment screw 38, and horizontal adjustment screw 30 on the string tree face. Most importantly each saddle contains a bore hole through which each string must pass which contains both on the witness side (fret side) as well as the string tree side a string bearing insert 40. The string bearing inserts comprise a special material of crystalline grown Ruby in the preferred embodiment. These materials may be optimum but the present invention is not limited to them as would be known by one skilled in this art. They are tubular elements with appropriate entrance and exit radii. They are pressed, glued, swaged or with other appropriate means affixed into the cylindrical seats within each of the saddles 36. The string bearing nut is affixed to the stringed instrument by applying wood type screws through the top of the base plate 34 and then reassembling the saddles or by applying machine screws from the bottom of the neck 12 into the baseplate 34. The string bearing at the string face (rear) in complement with the one at the witness point provides for a suitable and definitive string tree style guidance, thus eliminating the need for a separate string tree; shown in FIG. 1 part 20.

Additional preferred embodiments of the string bearing nut witness point invention include non-adjustable nuts with single or dual string bearing inserts, monolithic nuts molded from materials such as silicon carbide or other sintered and fired ceramic or ceramic-metal-plastic or metal alloys with single or dual string bearing surfaces and tubular or open topped styles such as v shaped.

Furthermore the preferred embodiment of the frets 42 and the finger board 58 string bearings are also constructed from the same materials as the other string bearings. The preferred material for the frets 42 is the crystalline grown Ruby or the other materials discussed for the string bearing nut witness point invention. The finger board 58 may be optimally made from materials such as silicon carbide, boron nitride or other sintered and fired ceramic or ceramic-metal-plastic or metal alloys with low thermal expansion coefficients.

Figure 4:
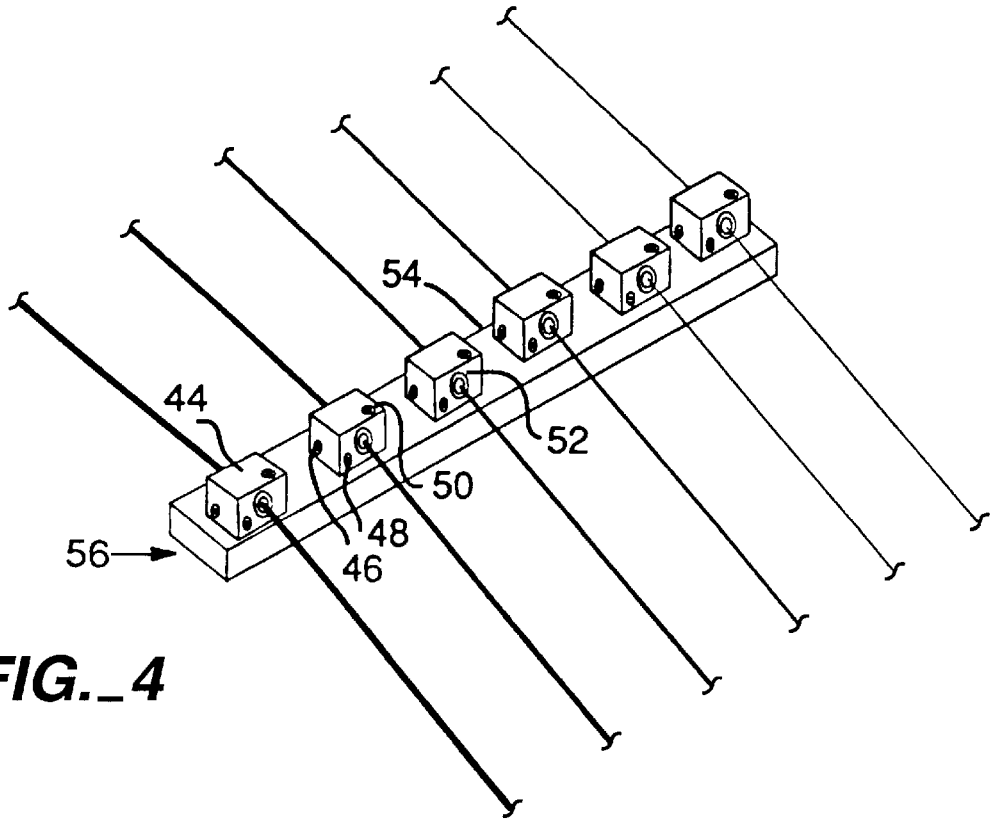
FIG. 4 shows a horizontally, vertically, and axially adjustable bridge containing low axial friction, high radial stiffness string bearing elements.

The preferred embodiment of the bridge witness point is shown in FIG. 4 and assembly 56. It consists of a base plate 54, six individually adjustable saddles 44, each with a horizontally, vertically, and axially adjustable feature, 46, 50, and 48 respectively. Each saddle 44 contains a bore hole through which each string must pass which contains a string bearing insert 52. The string bearing inserts comprise a special material of crystalline grown Ruby in the preferred embodiment which may be optimum but are not limited to them as would be known be one skilled in this art. They are tubular elements with appropriate entrance and exit radii specified. They are pressed, glued, swaged or other appropriate means affixed into the saddle seats 44. The bridge assembly 56 is affixed onto the surface of the instrument, or the structural element of a tremolo device by screws.

Additional preferred embodiments of the string bearing bridge witness point invention include non-adjustable bridges with bearing inserts, monolithic bridges molded from materials such as silicon carbide or other sintered and fired ceramic or ceramic-metal-plastic or metal alloys with string bearing surfaces. In addition to the tubular style string bearing open topped styles such as V shapes are utilized.

In addition a preferred embodiment for string bearing bridge witness point technology includes the use of the aforementioned materials as v-notch replacements in standard bridges, that is, to replace the typical v-grooves, u-grooves, and pulleys. Typical bridge v-grooves etc are constructed from brass or steel. In addition a similar embodiment can be used as an addition to the bridge witness point area of piezoelectric pickup bridge and elements.

Figure 5:
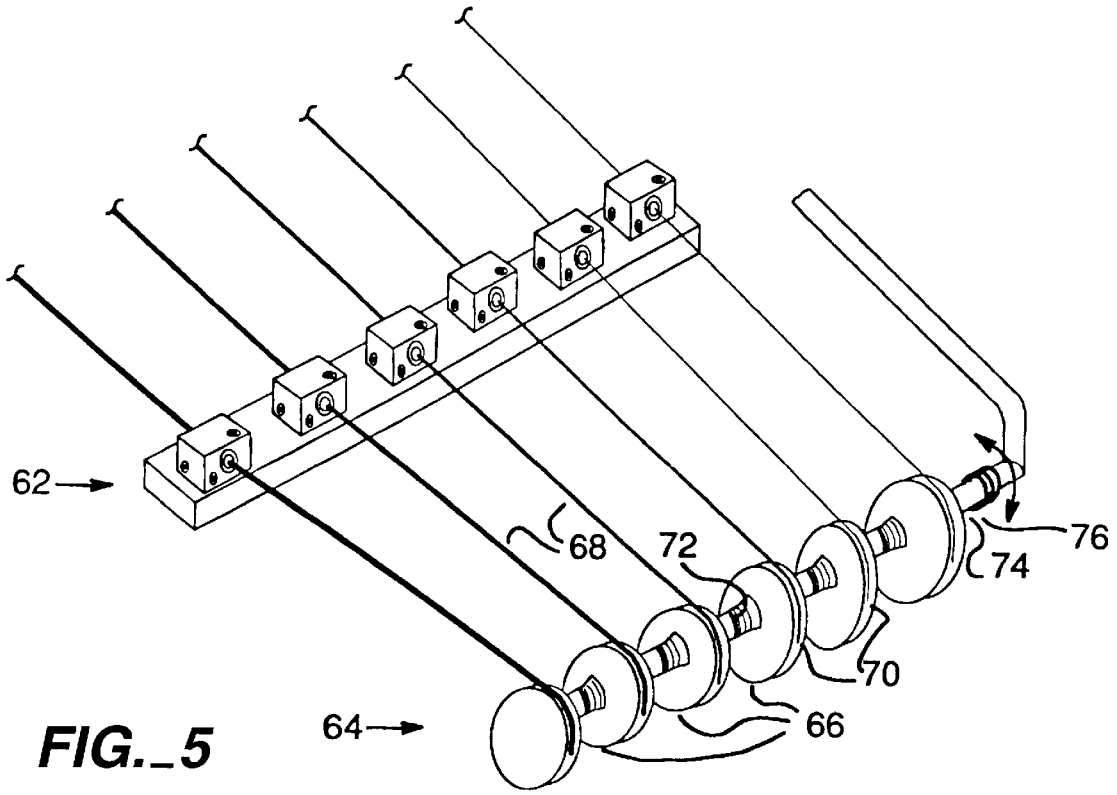
FIG. 5 shows a constant inter string pitch correction and pitch trajectory control tremolo and an adjustable low axial friction, high radial stiffness string bearing bridge. This tremolo embodiment contains non linear string tension devices from the group of substantially non circular pulleys whose shape has been calculated to provide said constant inter string pitch correction and pitch trajectory control multiplicand of the tremolo bar input angle.
Figure 6:
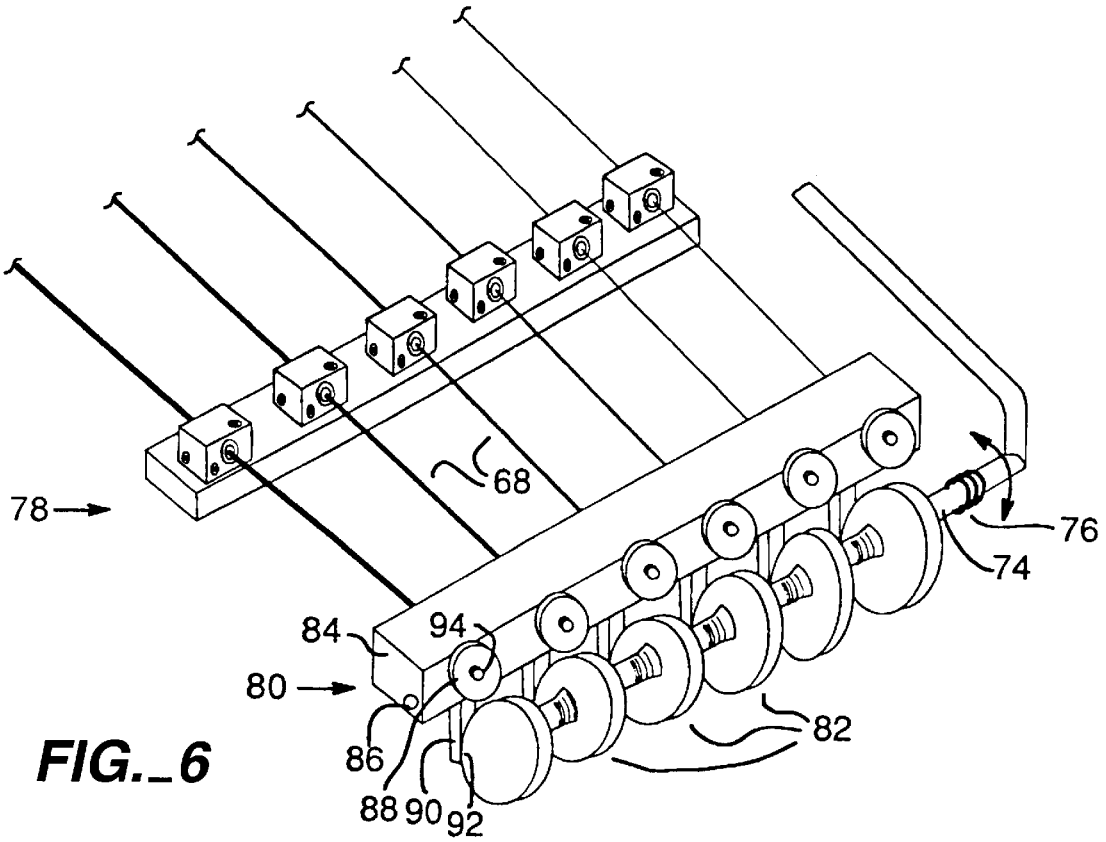
FIG. 6 also shows a constant inter string pitch correction and pitch trajectory control tremolo and an adjustable low axial friction high radial stiffness string bearing bridge. This tremolo embodiment contains non linear string tension devices from the group of substantially non circular cams whose shape has been calculated to provide said constant inter string pitch correction and pitch trajectory control multiplicand of the tremolo bar input angle. However this tremolo contains cam, cam follower, and piston elements as well.

The preferred embodiments of the constant inter string pitch correction and pitch trajectory control Tremolo Invention are shown in FIG. 5 and FIG. 6. The preferred embodiment contains the requisite functionality of maintaining the inter string relative pitches so as to remain within open tuning ratios at all tremolo input positions as well as providing that all strings approach or reach slackness together. Most importantly the preferred embodiment also provides that the pitches of each and all strings in addition to the aforementioned inter string correction also track the tremolo bar angle input position so as to provide for a choice of chromatic, linear, or natural pitch control trajectory. These functionalities are each delivered by a mechanism that converts tremolo bar angle into axial displacement unique for each string. Each string would individually receive a different amount of displacement change according to the function 'programmed' into the mechanism based upon which string size/style, pitch function (chromatic etc), and the tremolo bar input angle.

Two variations of the preferred embodiment are illustrated in FIGS. 5 and 6. FIG. 5 contains a string bearing bridge witness point 62 with each string 68 attached to its own non-linear string tension device 66 whose effective radii, at the string tangential point, has been determined by design to provide the pitch functions aforementioned. The pulley-like mechanism 66 is part of an assembly of individual and unique pulley like members 64. Each is tuned by its complex set of radii at the point of string tangents to deliver the requisite pitch functions. Each string is attached either at the strings termination or at some intermediate point to the pulley-like element with a suitable device located at 70. The pulley-like elements are linked by a shaft centric or eccentric 72. The input from the tremolo bar 76 is a shaft 74. String tension is held in force balance by suitable opposed torsion or other suitably affixed springs to the shaft 74 and tremolo assembly 76. A preferred embodiment variant could include a worm type drive to provide a zero force return of the tremolo arm thus segregating string tension from the tremolo. Suitable return springs would provide the return to open string tune position of the tremolo by applying a restoring force to the tremolo bar area and not to the string force area, as is the case of typical tremolos.

FIG. 6 shows a second preferred embodiment which also uses a string bearing bridge witness point 78 with each string 68. However this embodiment terminates all strings in a high vertical and horizontally stiff structure 84. Each string terminates in a piston 94 capable of only moving axially. Each piston is actuated from a lever 90 that pivots on a pin 86. The lever acts to both actuate the piston on the inside face of the piston cap 88 but also to be actuated by following the cam face 92. Each cam 82 is a non-linear string tensioning element whose effective radii, at the cam follower point 90, has been determined by design to provide the pitch functions aforementioned. The cam element is part of an assembly of individual cams 82 with each one unique and tuned by its complex set of radii at the point of cam follower tangents to delivery the requisite pitch functions. The cams are interconnected by a shaft 72 and the cam assembly is operated through a shaft 74 connected to the tremolo arm assembly 76. This embodiment 80 provides high dynamic and static stiffness 84 to the string terminations 94 and the tremolo bar 76 is fully isolated from the string tension 68. Suitable return springs 76 would provide the return to open string tune position of the tremolo by applying a restoring force to the tremolo bar area and not to the string force area.

Figure 6A:
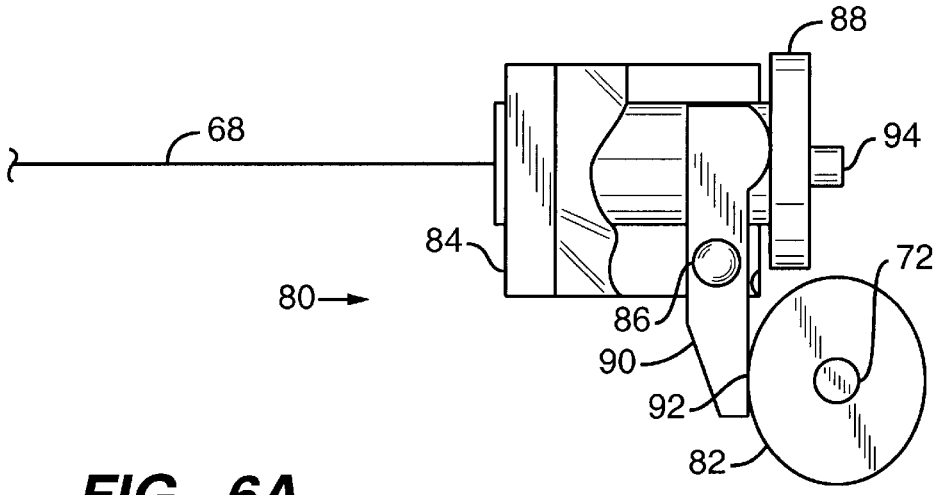
FIGS. 6A & 6B also shows the tremolo shown in FIG. 6 as a cut away drawing illustrating the cam, cam follower, piston actuator, piston, string terminator, and the assembly.

FIG. 6A shows the second preferred embodiment as a cut away drawing illustrating the cam 82, cam face 92, cam follower and piston actuator 90, piston and string terminator 88, and the assembly 80.

Figure 6B:
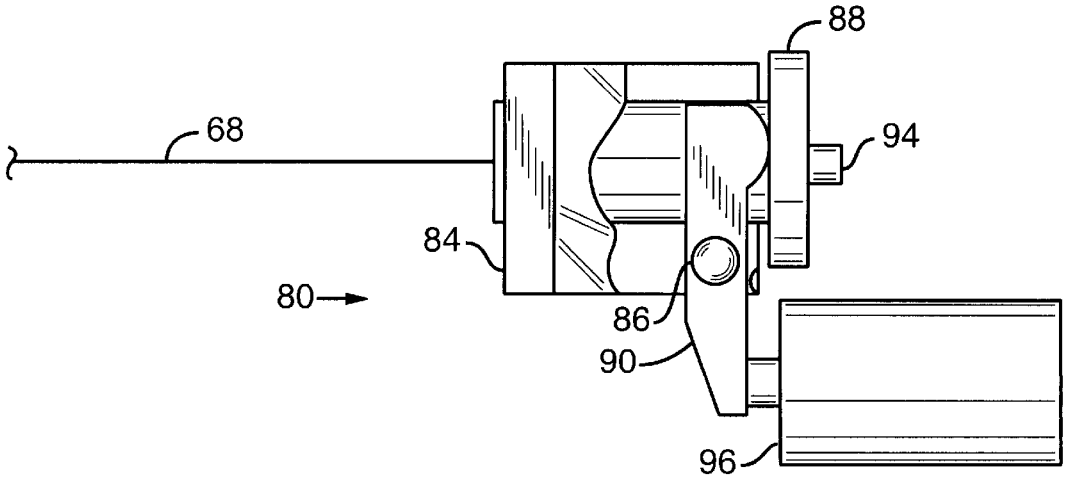

FIG. 6B shows another preferred embodiment where the non-linear string tensioning device is motivated by the axial motions of an electromechanical device 96 comprised from the group of electric motors and solenoids.

Figure 7:
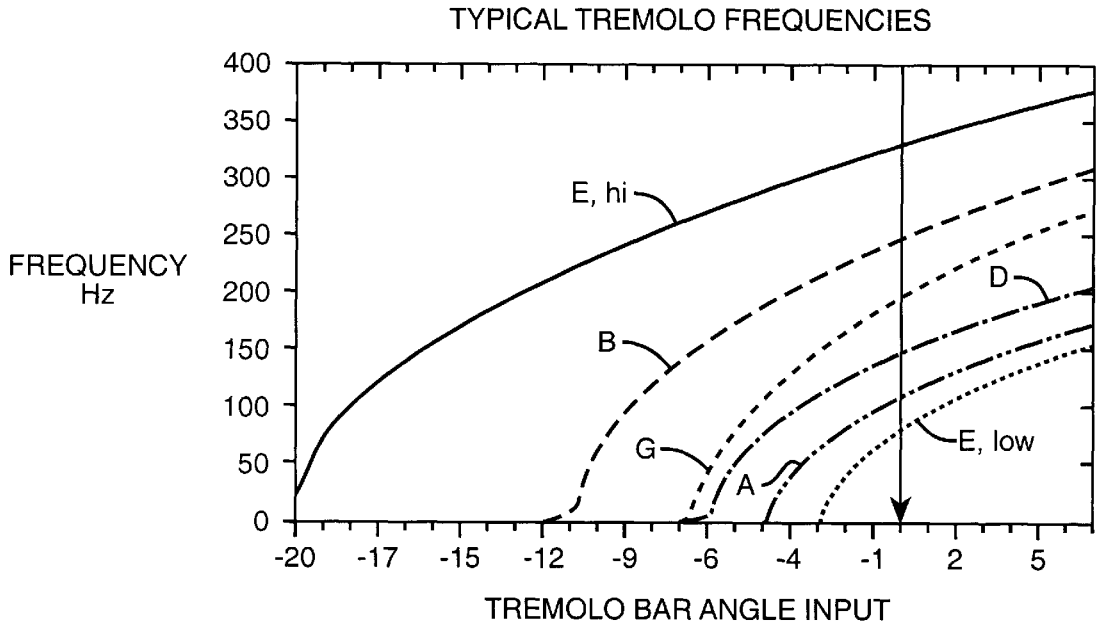
FIG. 7 shows a plot of the frequencies (pitches) of all six strings on a guitar with a typical tremolo. These frequencies here, as in the following plots, represent the result of the tremolo bar input angle swinging from −20° to +5°, a typical range.

FIG. 7 shows a plot of a typical tremolo's frequencies for all six strings. Note how the pitch trajectories are all askew and are not coherent. The strings also go towards slack at different rates.

Figure 7A:
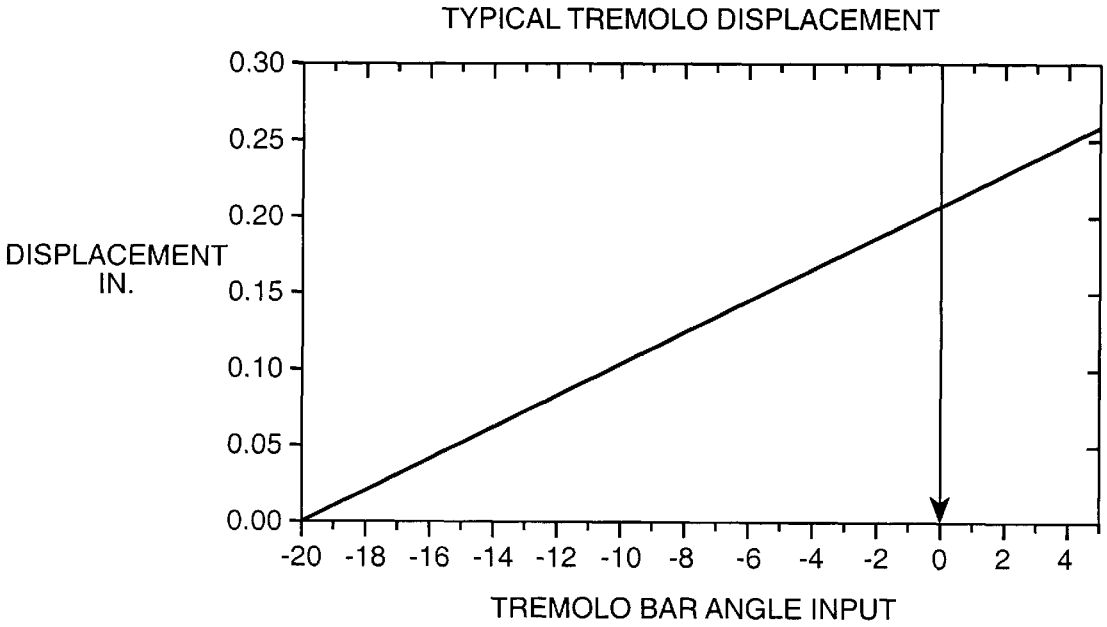
FIG. 7A shows a plot a typical tremolo's, tremolo bar input angle versus string tensioning displacement at the string termination. This displacement curve would produce pitches that correspond to FIG. 7.

FIG. 7A shows a plot of a typical tremolo's tremolo bar input angle versus tensioning displacement at the string termination. Note how all six strings change displacement at the same rate.

Figure 8:
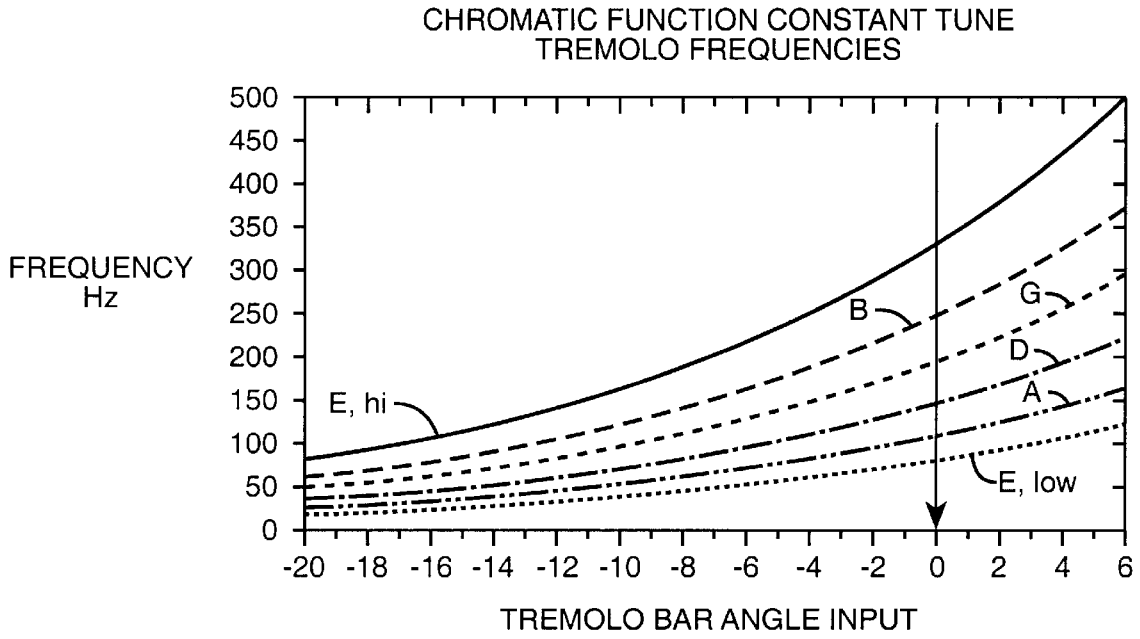
FIG. 8 shows a plot of the frequencies of all six strings on a guitar with constant inter string pitch correction and Chromatic pitch trajectory control tremolo by means of a square of $2^{\Phi/K1}$ multiplicand.

FIG. 8 shows a plot of the frequencies of all six strings on a guitar with constant inter string pitch correction and Chromatic pitch trajectory control tremolo by means of a square of $2^{\Phi/K1}$ multiplicand. Note how the pitch frequencies have a constant relative tune ratio set and that the overall pitch trajectories follow a chromatic path.

Figure 8A:
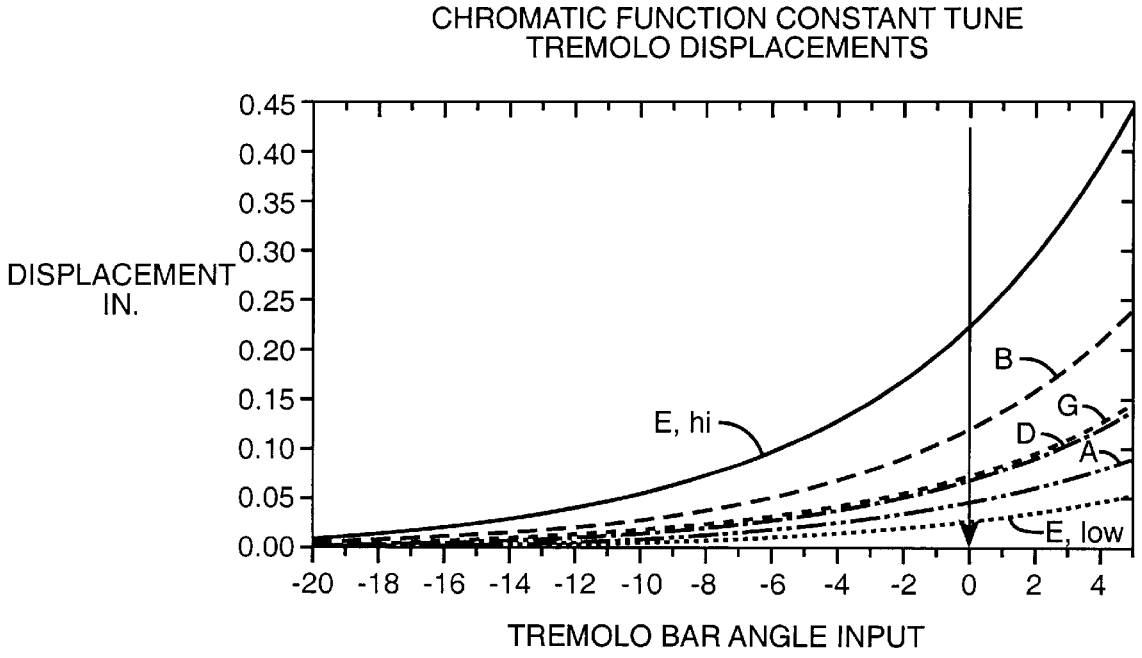
FIG. 8A shows a plot of the table of tremolo bar input angle versus tensioning displacements at the string termination required for constant inter string pitch correction and Chromatic pitch trajectory control. This displacement curve would produce pitches that correspond to FIG. 8.

FIG. 8A shows a plot of the table of tremolo bar input angle versus tensioning displacements at the string termination required for constant inter string pitch correction and Chromatic pitch trajectory control. This displacement curve is required to produce the pitches found in FIG. 8.

Figure 9:
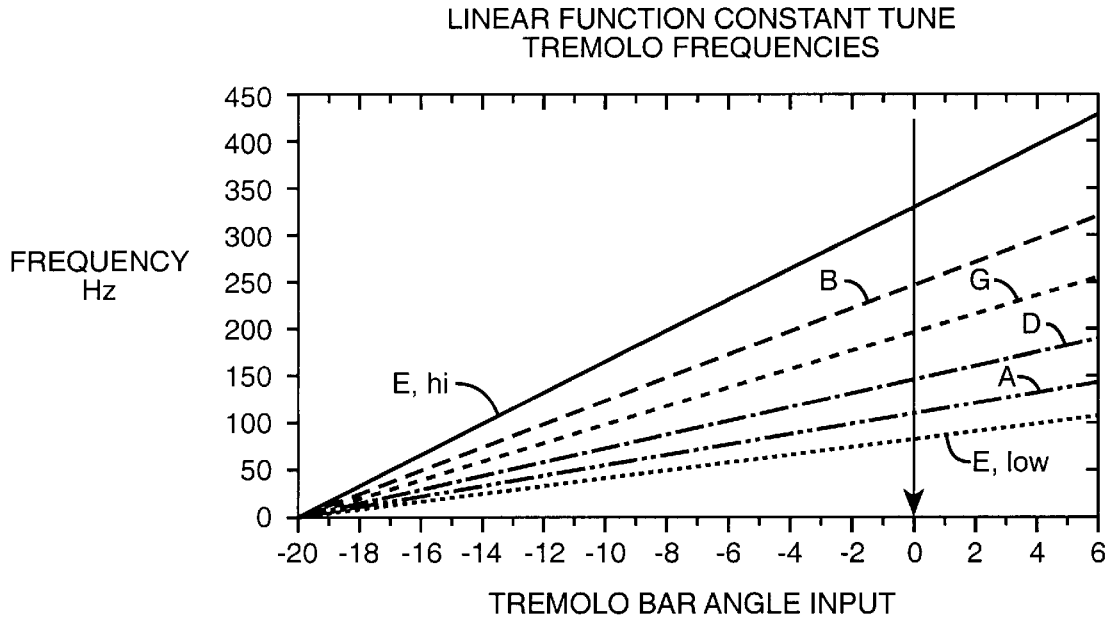
FIG. 9 shows a plot of the frequencies of all six strings on a guitar with constant inter string pitch correction and Linear pitch trajectory control tremolo by means of a square of $\phi \times K2$ multiplicand.

FIG. 9 shows a plot of the frequencies of all six strings on a guitar with constant inter string pitch correction and Linear pitch trajectory control tremolo by means of a square of $\phi \times K2$ multiplicand. Note the linear pitch trajectories while maintaining a constant inter tune relationship.

Figure 9A:
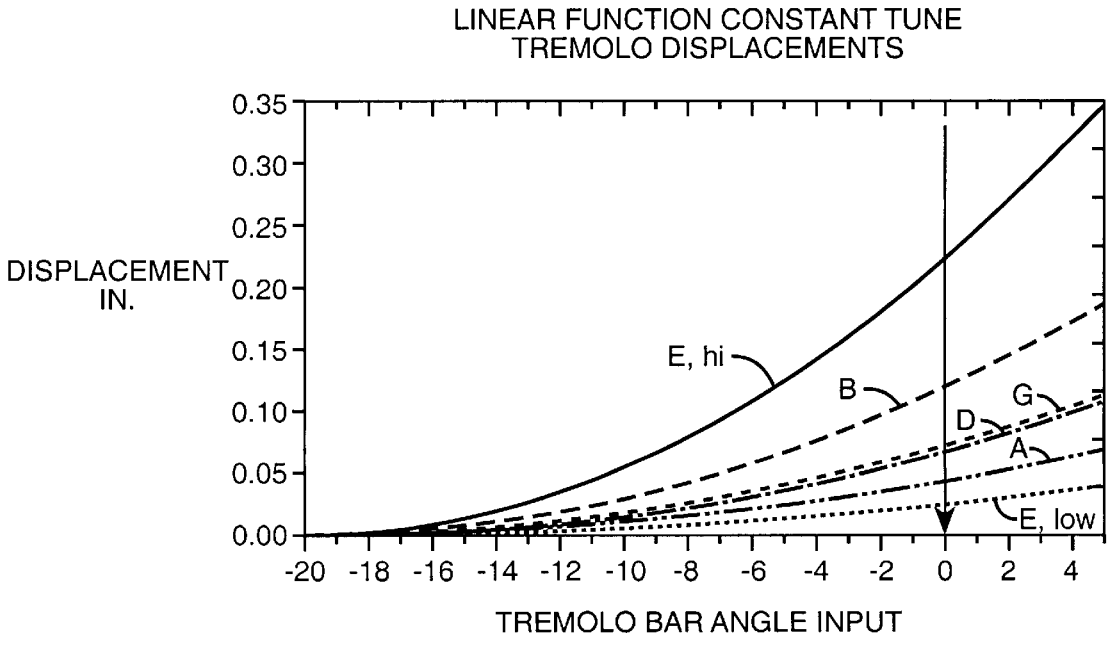
FIG. 9A shows a plot of the table of tremolo bar input angle versus string tensioning displacements at the string termination required for constant inter string pitch correction and Linear pitch trajectory control. This displacement curve would produce pitches that correspond to FIG. 9.

FIG. 9A shows a plot of the table of tremolo bar input angle versus tensioning displacements at the string termination required for constant inter string pitch correction and Linear pitch trajectory control. This displacement curve is required to produce the pitches found in FIG. 9.

Figure 10:
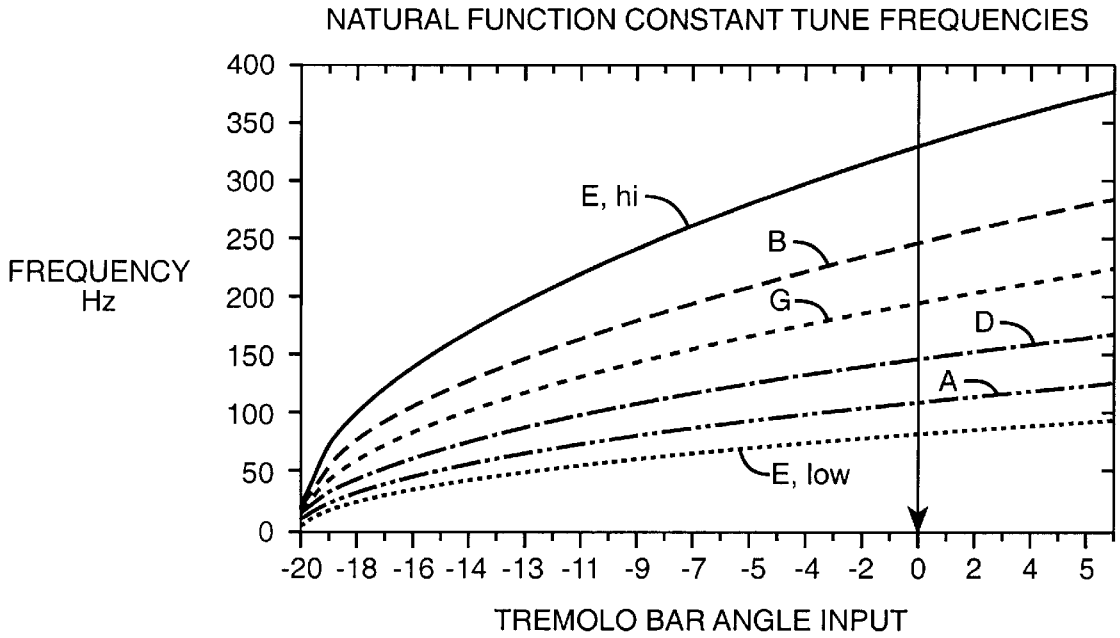
FIG. 10 shows a plot of the frequencies of all six strings on a guitar wih constant inter string pitch correction and Natural pitch trajectory control tremolo by means of a $\phi \times K3$ multiplicand.
Figure 10A:
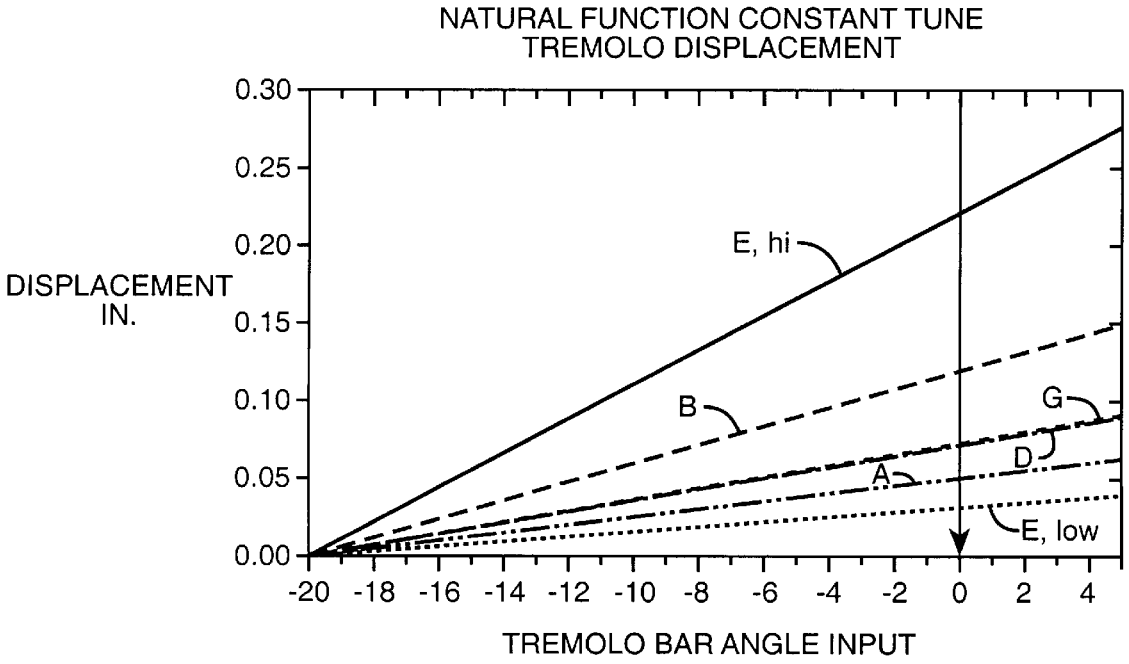
FIG. 10A shows a plot of the table of tremolo bar input angle versus string tensioning displacements at the string termination required for constant inter string pitch correction and Natural pitch trajectory control. This displacement curve would produce pitches that correspond to FIG. 10.

FIG. 10 shows a plot of the frequencies of all six strings on a guitar with constant inter string pitch correction and Natural pitch trajectory control tremolo by means of a $\phi \times K3$ multiplicand. Note the natural pitch trajectories while maintaining a constant inter tune relationship FIG. 10A shows a plot of the table of tremolo bar input angle versus tensioning displacements at the string termination required for constant inter string pitch correction and Natural pitch trajectory control. This displacement curve is required to produce the pitches found in FIG. 10.

Another preferred embodiment of this invention not shown in these figures would act to provide a constant inter string pitch correction and pitch trajectory control tremolo action by depressing the strings between the bridge and the string termination area. Initial depression would achieve a stretch suitable for open string tuning and with additional depression the pitch would upshift while a lessoning of the depression would down shift the pitch. A non-linear string tension device would provide the pitch function as aforementioned.

Another preferred embodiment of this invention, shown in FIG. 6B, would act to provide a constant inter string pitch correction and pitch trajectory control tremolo action by the displacement change due to the operation of non-linear string tension device based upon electrically activated solenoids and motors 96 where its complex set of displacements delivers the requisite pitch functions. The actual function of the electrically activated solenoids and motors would be the result of computations and stored parameters in a microprocessor based system.

A further preferred embodiment includes return springs that utilize the ideal characteristics of strings or string like materials for return spring materials.

An aspect of these preferred embodiments would be the utilization of the materials aforementioned for string bearing witness point and fret technology for use as high radial stiffness low circumferential friction journal bearings to replace the knife edge and post pivots in typical tremolos.

Operation of the FIGS. 1 through 10A

In operation the user will thread their strings 18 through the holes 40 of the string bearing inserts on the witness points of the string bearing bridge 56 and nut 32. The string tree side string bearings 40 of the nut witness point system 32 will act in a string tree manner (similar to the action of a traditional string tree 20) to guide the strings towards the tuning machines. The user can then tune the strings in any of the usual manners. The adjustable nature of the nut and bridge witness points will require the art of a stringed instrument technician, as is usual, to adjust height 38 or 50, width 30 or 46, and axial 48 dimensions so as to provide good intonation. The user will require much less retuning than is in than case of typical v-notch brass or bone nuts and bridges. Moreover any micro tuning adjustments during use can be performed with the standard tuning machines and without the tools or activities required by locking nut and bridge witness point systems.

The use of the string bearing frets 42 or string bearing fingerboards 58 will be as usual with the result of greater witness point dynamics such as increased sustain and feel during use and the reduction to zero of the wearing of the surfaces.

With the exception of the string terminations, 70 or 94 respectively, the two tremolo designs shown in FIGS. 5 and 6 operate the same. An angle input from the tremolo bar 74 and its reaction from the strings/return springs 74 and dual return springs 76 in FIG. 6 control the angular position of the non-linear string tension device's pulley 66 or cam 82 shafts 72. The pulley radii at the string tangential position FIG. 5, or the cam radii at the follower intersection FIG. 6, respectively governs and adjusts the relative string pull to provide constant inter string tune, slack coherency, and the choice of chromatic, linear, or natural pitch trajectory control and adjustment.

FIG. 6A shows in exposed drawing format the piston 88 in the cylinder 84 and assembly 80. The cam 82 is in tangential contact to the cam follower 90 which pivots on the pin 86 and presses in the contact face of the piston cap 88 thus adding or relieving tension displacement.

FIG. 7 shows the sweep of frequencies that occur during the movement of a tremolo bar on a typical tremolo while FIG. 7A shows that all the strings move the same degree of displacement regardless of string type. The frequencies shown in FIG. 7 show many uncoordinated pitch trajectories during operation.

FIG. 8 shows the operation of the constant inter string pitch correction and Chromatic pitch trajectory control tremolo during operation where the frequencies have chromatic pitch trajectories and remain in constant inter tune pitch relationship during tremolo bar 74 use. FIG. 8A shows the displacement curve, at the string termination 70 or 94, that the non-linear string tensioning device must create exactly during operation to provide the Chromatic pitch trajectories that are shown in FIG. 8.

FIG. 9 shows the operation of the constant inter string pitch correction and Linear pitch trajectory control tremolo during operation where the frequencies have linear pitch trajectories and remain in constant inter tune pitch relationship during tremolo bar 74 use. FIG. 9A shows the displacement curve, at the string termination 70 or 94, that the non-linear string tensioning device must create exactly during operation to provide the Linear pitch trajectories that are shown in FIG. 9.

FIG. 10 shows the operation of the constant inter string pitch correction and Natural pitch trajectory control tremolo during operation where the frequencies have natural pitch trajectories and remain in constant inter tune pitch relationship during tremolo bar 74 use. FIG. 10A shows the displacement curve, at the string termination 70 or 94, that the non-linear string tensioning device must create exactly during operation to provide the Natural pitch trajectories that are shown in FIG. 10.

Summary, Ramification, and Scope

The reader will see applicant's have illustrated herein a complete new string bearing invention technology set and a new tremolo device that delivers a unique set of functionalities not possible with prior art inventions patented or otherwise.

The reader will see that string bearing witness point technology delivers the advantage of low friction in the axial direction while delivering high stiffness and energy resiliency in the radial directions which provides the user an experience of longer sustain, greater tone, more stable tone and phase decay, better feel, stable tuning, improved intonation accuracy, and smoother tremolo action/reaction, and force feedback. In addition the mechanical advantages should include the use of no nut wrenches or handle adjustments required, strings will not become plastically deformed (kinked), tuning adjustments are single step only, intonation adjustments are easier, no string tree guides are required, and strings should not cut themselves deeper into the nut grooves with time thus reducing high maintenance cost procedures, such as fret filing and intonation adjustments.

The reader will also see that the tremolo designs as illustrated, but not limited to them, have an advantage in that the dynamic characteristics of the tremolo construction as in regards to transmission and re-transmission of acoustic stress wave signals and in regards to reflection and anti-reflection and impedance matching of the various elements have been optimized to minimize signal mismatches and possess various elements that have closely matched mechanical stiffness and damping parameters between each another, as well as to the body and neck of the instrument.

Secondly the reader will see that these tremolo designs offer the advantage that the tremolo mechanism assembly does make appropriate and smooth continuous correction to each individual strings'tension so as to adjust each individual pitch to maintain the pitch of all the stings in constant inter string pitch relative tuning and intonation. In other words pitches of the string set, which when in tune are High E, B, G, D, A, and Low E (2 octaves down), would remain always in this pitch relative ratios regardless of the tremolo bar input angle.

Thirdly the reader will also see that the invention's tremolo design will provide the advantage that all strings approach and reach slack tension coherently and simultaneously.

Lastly the reader will also see the advantage of the chromatic, linear or natural pitch trajectory control tremolo. Most significantly the reader should see the large and unique advantages to the playability these invention's functionality provide to any musician trained in playing and composing chromatically correct music.

It is to be understood that many variations and modifications could be performed by one skilled in the appropriate arts and yet utilize the same method and principles explained and taught here.

While the embodiment of this invention shown and described is fully capable of achieving the object and advantages desired, it is to be understood that the particular embodiments shown have been for purposes of illustrations only, and not for purposes of limitation.

What is claimed as invention is:

1. A stringed instrument, comprising:

a body;

a plurality of witness points connected to said body consisting of elements taken from the group of bridges, slant bridges, inverted slant bridges, floating bridges, saddles, nuts, frets, fingerboards, dampers, soundboards, and capodastro;

a plurality of strings connected from end to end on said body so as to cross and be able to be placed into contact with said witness points;

at least some of said witness points including a plurality of string bearing members enabling axial motion of said strings; and at least some of said string bearing members supported by saddle assemblies conditioned to provide horizontal, vertical, and axial position adjustments or fixed position, said saddle assemblies comprised of material for preventing said saddle assemblies from vibrating axially relative to said string bearings.

2. The stringed instrument of claim 1 wherein said string bearings are composed of a material selected from the group of crystalline ruby and sapphire or quartz, or the group of aluminum oxides, silicon carbide, plastics, ceramics or piezoelectric materials, graphite composites or metals.

3. The stringed instrument of claim 2 wherein said fingerboards are composed of said string bearing material.

4. The stringed instrument of claim 2 wherein said witness points comprise a nut, bridge, and frets, and said frets are composed of said string bearing material.

5. The stringed instrument of claim 1 wherein said string bearings include means of position adjustment in the horizontal, vertical, and axial positions.

6. The stringed instrument of claim 1 wherein said string bearings are in a fixed position.

7. The stringed instrument of claim 1 wherein said string bearings comprises a fret.

8. A method of manufacturing a stringed instrument, comprising the steps of:

providing a body;

connecting a plurality of witness points to said body, said witness points consisting of elements taken from the group of bridges, slant bridges, inverted slant bridges, floating bridges, saddles, nuts, frets, fingerboards, dampers, soundboards, and capodastro;

connecting a plurality of strings from end to end on said body so as to cross and be able to be placed into contact with said witness points;

attaching string bearing members to at least some of said witness points, said string bearing members enabling axial motion of said string; and supporting at least some of said string bearing members with saddle assemblies conditioned to provide horizontal, vertical, and axial position adjustments or fixed position, said saddle assemblies comprised of material for preventing said saddle assemblies from vibrating axially relative to said string bearings.

9. The method of manufacturing a stringed instrument of claim 8 wherein said string bearings are composed of a material selected from the group of crystalline ruby and sapphire or quartz, or the group of aluminum oxides, silicon carbide, plastics, ceramics or piezoelectric materials, graphite composites or metals.

10. The method of manufacturing a stringed instrument of claim 9 wherein said fingerboards are composed of said string bearing material.

11. The method of manufacturing a stringed instrument of claim 9 wherein said witness points comprise a nut, bridge, and frets, and said frets are composed of said string bearing material.

12. The method of manufacturing a stringed instrument of claim 8 wherein said string bearings include means of position adjustment in the horizontal, vertical, and axial positions.

13. The method of manufacturing a stringed instrument of claim 8 wherein said string bearings are in a fixed position.

14. The method of manufacturing a stringed instrument of claim 8 wherein said string bearings comprise a fret.

15. A tremolo device for constant inter string pitch correction and pitch trajectory control in combination with a stringed instrument comprising:

a plurality of non-linear string tension devices, one per string;

said non-linear string tension devices providing conversion means for tremolo bar input angle to individual string tensioning in the axial direction;

said non-linear string tensioning devices providing tensioning displacement as a function of said tremolo bar input angle;

said non-linear string tensioning devices comprising a multiplicand from the group comprised of square of $2\phi/K1$ for chromatic pitch trajectory control, and square of $\phi \times K2$ for linear pitch trajectory control, and $\phi \times K3$ for natural pitch trajectory control, whereas $\phi$ is the tremolo bar input angle and K1, and K2, and K3 are the string's chromatic, linear, and natural pitch trajectory coefficients; and said non-linear string tensioning devices including means for termination of said strings.

16. The tremolo device of claim 15 wherein said device provides constant inter string pitch correction.

17. The tremolo device of claim 15 wherein said non-linear string tensioning device provides said chromatic pitch trajectory control.

18. The tremolo device of claim 15 wherein said non-linear string tensioning device provides said linear pitch trajectory control.

19. The tremolo device of claim 15 wherein said non-linear string tensioning device provides said natural pitch trajectory control.

20. The tremolo device of claim 15 wherein said device provides said pitch trajectory control of the combination of said chromatic and linear and natural pitch trajectories.

* * * * *